United States Patent [19]

Keys

[11] Patent Number: 4,678,563

[45] **Date of Patent: * Jul. 7, 1987**

[54] MODIFIED ALCOHOL FROTHERS FOR FROTH FLOTATION OF SULFIDE ORE

[75] Inventor: Robert O. Keys, Columbus, Ohio

[73] Assignee: Sherex Chemical Company, Inc., Dublin, Ohio

[ * ] Notice: The portion of the term of this patent subsequent to Mar. 12, 2002 has been disclaimed.

[21] Appl. No.: 731,713

[22] Filed: May 7, 1985

[51] Int. Cl.[4] ..... B03D 1/14

[52] U.S. Cl. ..... 209/166; 252/61

[58] Field of Search ..... 209/166, 167; 252/61

[56] References Cited

U.S. PATENT DOCUMENTS

| | | | |
|---|---|---|---|
| 2,695,101 | 11/1954 | Booth et al. . | |
| 2,803,345 | 8/1957 | Jacobs | 209/166 |
| 3,710,939 | 1/1973 | Hostynek et al. . | |
| 4,171,261 | 10/1979 | Dorrepaal et al. | 252/61 |
| 4,329,233 | 5/1982 | Ramadorai et al. . | |
| 4,394,257 | 7/1983 | Wang et al. . | |
| 4,414,107 | 11/1983 | Parlman et al. . | |
| 4,504,385 | 3/1985 | Keys | 209/166 |

FOREIGN PATENT DOCUMENTS 671853 7/1979 U.S.S.R. .

OTHER PUBLICATIONS

March, *Advanced Organic Chemistry,* Second Ed., 1977, pp. 363–367, McGraw Hill Book Co.

Schick, *Nonionic Surfactants,* pp. 8–37, Marcel Dekker, Inc.

Fieser, *Advanced Organic Chemistry,* 1961, p. 478, Reinhold Publishing Corp., New York.

Bruson, *Organic Reactions,* pp. 79–135.

*Primary Examiner*—Bernard Nozick

*Attorney, Agent, or Firm*—Mueller and Smith

[57] ABSTRACT

Disclosed is a process for the concentration of sulfide ore wherein an aqueous slurry of sulfide ore particles are subjected to sulfide ore froth flotation under sulfide ore froth flotation conditions. The improvement in process comprises using an effective amount of a frothing agent selected from the group consisting of:

(a) the reaction product of a $C_5$–$C_{10}$ diol and a $C_1$–$C_7$ carboxylic acid;

(b) the reaction product of a $C_5$–$C_{10}$ diol and an acrylonitrile;

(c) the reaction product of a $C_2$–$C_4$ alkylene oxide and a $C_1$–$C_7$ carboxylic acid;

(d) the reaction group of a $C_2$–$C_4$ alkylene oxide and a $C_5$–$C_{10}$ diol;

(e) the reaction product of a $C_2$–$C_4$ alkylene oxide and an acrylonitrile; and (f) mixtures thereof, the resulting modified alcohol frothing agents have at least one hydroxyl group thereon. The modified alcohol frothing agents of the present invention provide improved flotation kinetics and selectivity in the sulfide ore float.

13 Claims, No Drawings

MODIFIED ALCOHOL FROTHERS FOR FROTH FLOTATION OF SULFIDE ORE

BACKGROUND OF THE INVENTION

The present invention relates to the concentration of mineral ores by froth flotation and more particularly to the concentration of a sulfide ore by froth flotation.

It is common practice in froth flotation to utilize chemical reagents in order to enhance concentration of a desired fraction of an ore subjected to the process. For example, a chemical collector which is selectively adsorbed on the surface of the particles to be collected or a frothing agent or frother for enhancing the froth texture are but two of the various types of chemical reagents which generally are used in froth flotation for beneficiation of ores. For example, sulfide ores have been beneficiated traditionally by employment of a double flotation process with multiple re-cleaning stages. The sulfide ore first is comminuted and classified to the optimum particle size for admission to the first stage of the flotation process. In the first flotation stage (so-called rougher or bulk float), the sulfide mineral values are separated from various silica and silicate gangue materials by utilization of a frother and a xanthate salt or other thiol collector. The resulting sulfide mineral concentrate, typically a mixture of various sulfide minerals, may be ground further to a fine particle size and subjected to a second stage (cleaner or differential flotation) wherein the various mineral sulfides are again floated for selective recovery of one valuable sulfide mineral from other sulfide minerals contained in the admixture thereof, or to upgrade the quality of the concentrate to obtain a desired grade product. For example, molybdenum sulfide and copper sulfide collected in the rougher float can be separated from each other, e.g., by depressing the copper sulfide values utilizing reagents such as sodium hydrogen sulfide, Nokes reagent, and the like, followed by flotation of the molybdenum values. The float accomplishes differential separation typically by pH adjustment of the pulp and/or addition of specific depressants, activators, modifiers, or like conventional techniques.

Relative to the rougher float, xanthate or other thiol collectors can be rather selective in separating sulfide values from oxide impurities, especially in the presence of a frothing agent such as methyl isobutyl carbinol (MIBC) or pine oil. Molybdenum sulfide ore, however, generally does not require such a thiol-containing collector; however, non-polar hydrocarbon oils typically are used as collectors. A variety of conditioning and modifying reagents, though, have been proposed in the sulfide flotation field.

BROAD STATEMENT OF THE INVENTION

The present invention is directed to an improved froth flotation process for the concentration of a sulfide ore wherein an aqueous slurry of sulfide ore particles are subjected to sulfide ore froth flotation under sulfide ore froth flotation conditions. The improvement comprises the use of an effective amount of a frothing agent. The frothing agent is selected from the group consisting of:

(a) the reaction product of a $C_5$–$C_{10}$ diol and a $C_1$–$C_7$ carboxylic acid in a ratio of one mole of carboxylic acid per mole of diol and having the predominant structural formula of $$HO-(C_nH_{2n})-O-\overset{\overset{\displaystyle O}{\|}}{C}-(C_xH_{2x})-H$$

where n=5–10 and x=0–6;

(b) the reaction product of a $C_5$–$C_{10}$ diol and acrylonitrile in a one to one mole ratio of acrylonitrile to diol such that the reaction product retains at least one hydroxyl group and having the predominant structural formula of $$HO-(C_nH_{2n})-O-CH_2\overset{\overset{\displaystyle (C_mH_{2m+1})}{|}}{C}H-C{\equiv}N$$

where n=5–10 and m=0–3;

(c) the reaction product of between about 1 and 10 moles of a $C_2$–$C_3$ alkylene oxide per mole of a $C_1$–$C_7$ carboxylic acid and having the predominant structural formula of $$H-(C_xH_{2x})-\overset{\overset{\displaystyle O}{\|}}{C}-O-(C_yH_{2y}O)_z-H$$

where x=0–6, y=2–3, and z=1–10;

(d) the reaction product of a $C_2$–$C_4$ alkylene oxide and 1 mole of $C_5$–$C_{10}$ diol having the predominant structural formula of $$HO-(C_nH_{2n})-O-(C_yH_{2y}O)_z-H$$

where n=5–10, y=2–3, and z=1–10; and (e) the reaction product of a $C_2$–$C_4$ alkylene oxide and an acrylonitrile; and (f) mixtures thereof.

Advantages of the present invention include excellent recovery yields of sulfide particles in a froth flotation process and improved flotation kinetics of the particles for increased throughput of ore subjected to the process. Another advantage is the ability of the modified alcohol frothers to operate in harmony with sulfide collectors, fuel oil extenders, and like conventional sulfide flotation additives. A further advantage is the ability to utilize lower dosages of the modified alcohol frothers of the present invention compared to conventional frothers while improving selectivity and kinetics in the float. These and other advantages of the process will become readily apparent to those skilled in the art based upon the disclosure contained herein.

DETAILED DESCRIPTION OF THE INVENTION

The present invention works effectively and efficiently on separation and concentration of sulfide minerals from natural sulfide ores, though synthetic sulfide ores and blends of natural and synthetic metal sulfides are comprehended within the scope of the present invention. Typically, the sulfide mineral will be a metal sulfide typical of sulfide ores such as, for example, molybdenite, pyrite, galena, chalcopyrite, sphalerite, chalcocite, covellite, bornite, pentlandite, enargite, cinnabar, stibnite, and the like. Typical impurites or gangue material found with natural sulfide ores and which are desired from separation therefrom include, for example, silica and silicates, and carbonates, though additional gangue materials often are encountered.

$C_5$–$C_{10}$ diols for use in synthesizing the modified alcohol frothing agents of the present invention may be primary diols (e.g. glycols), but preferably the diols will contain a secondary hydroxyl group. Additionally, while the diols can be linear in structure, preferably the diols will contain alkyl branching, especially methyl branching, in order to enhance sulfide recovery. Most preferably, the diols will be branched and contain a secondary hydroxyl group. Representative $C_5$–$C_{10}$ diols which may be used in synthesizing the modified alcohol frothers of the present invention include, for example, 2,2,4-trimethyl-1,3-pentane diol (TMPD), 2-ethyl-1,3-hexane diol, 1,6-hexane diol, neo-pentyl glycol, and the like and mixtures thereof. TMPD is a preferred diol as the examples will demonstrate.

$C_1$–$C_7$ carboxylic acids for use in synthesizing the modified alcohol frothing agents of the present invention include, for example, formic acid, acetic acid, propionic acid, butyric acid, valeric acid (pentanoic acid), caproic acid (hexanoic acid), heptanoic acid, and mixtures thereof. While such carboxylic acids can be linear, branched $C_1$–$C_7$ carboxylic acids are quite useful in synthesizing the modified alcohol frothing agents of the present invention.

An ester-alcohol modified frother of the present invention is the reaction product of the $C_5$–$C_{10}$ diol and the $C_1$–$C_7$ carboxylic acid. Such modified alcohol frothing agent may be formed by the esterification reaction of the diol and the mono-carboxylic acid or by a conventional transesterification reaction. Regardless of which procedure is chosen, only one mole of carboxylic acid per mole of diol is used in the reaction procedure in order that the resulting modified frother retain a hydroxyl group. Conventional esterification or transesterification conditions for this condensation reaction are maintained.

Another form of the modified frother of the present invention is the reaction product of the $C_5$–$C_{10}$ diol and the alkylene oxide compound. Suitable alkylene oxides include, for example, ethylene oxide, propylene oxide, butylene oxide, and mixtures thereof. Higher alkylene oxides may be used in forming the modified frothing agent; however, their cost and unavailability make them quite impracticable in a cost conscious market. The reaction of alkylene oxides with alcohols is such a well-known reaction that further details will be omitted. The number of moles of alkylene oxide reacted with the diol generally will range from about 2 to 10 or more moles of alkylene oxide per mole of diol. It should be noted that when the alkoxylated diol frother contains both a secondary and a primary hydroxyl group, that the primary hydroxyl group may be capped to leave only the secondary hydroxyl group as the only hydroxyl group in a frother. Suitable capping agents include, for example, methyl chloride, dimethyl sulfate, phenyl isocyanate, methyl isocyanate, and the like and mixtures thereof.

A further modified alcohol frother of the present invention is the reaction product of the $C_5$–$C_{10}$ diol and an acrylonitrile. Referring to the nitrile reactant in forming such novel frother of the present invention, economy and efficiency dictate that acrylonitrile be utilized, although methacrylonitrile, ethacrylonitrile, crotononitrile, and like substituted acrylonitriles may find utility in forming the frothers of the present invention. The reaction of an acrylonitrile and an alcohol is a specialized type of a Michael reaction known as cyanoethylation. Cyanoethylation is conducted in the presence of a basic catalyst and results in the formation of an ether nitrile. The molar proportions of reactants are adjusted such that at least one hydroxyl group is residual on the reaction product, such hydroxyl group typically coming from the diol. More on cyanoethylation can be found in Fieser and Fieser, *Advanced Organic Chemisty,* page 478, Reinhold Publishing Corporation, New York, N.Y. (1961) and Bruson *Org. React.,* 5, 79–135 (1949), especially pages 89–95 and 121–128.

A third form of the modified alcohol frothers of the present invention is the reaction product of an alkylene oxide and the $C_1$–$C_7$ carboxylic acid. The same alkylene oxides and carboxylic acids described above in connection with other forms of the modified alcohol frothers of the present invention are utilized in forming this embodiment of the modified alcohol frothers of the present invention. The number of moles of alkylene oxide reacted with the mono-carboxylic acid generally will range from about 2 to 10 moles or more of alkylene oxide per mole of acid.

A further embodiment of the modified alcohol frothing agents of the present invention is the reaction product of an alkylene oxide and an acrylonitrile. Again, the same description of alkylene oxides and acrylonitriles given above obtain for this embodiment of the modified alcohol frothers of the present invention. Regardless of which form of frother is synthesized, the proportion of frother utilized in the flotation process typically ranges from about 0.001 g/kg to about 0.5 g/kg (grams of frother per kilogram of ore), though higher dosages may find use in the process. Advantageously, the dosage of frother will range from about 0.01 to about 0.2 g/kg.

Sulfide collectors which are used to effect the selective flotation process most commonly are xanthate salts, though mercaptans, dialkyl thionocarbamates, dialkyldithiophosphates, xanthogen formates, and other thiosalts are functional in the float. Xanthates predominate in commercial use because of their effectiveness to function in the process and because xanthates are quite economical in cost. Typical conventional xanthate salt collectors include, for example, potassium ethyl xanthate, potassium sec-butyl xanthate, potassium propyl xanthate, and the like and mixtures thereof. Conventional dosages of xanthate collectors normally range from about 0.005 to about 0.25 g/kg. It should be noted that molybdenum sulfide ores generally do not require such sulfide collectors.

In practicing the present invention, the sulfide ore to be subjected to the froth flotation process can be comminuted or attrited followed by size classification to prepare the ore for admission to the first step of the flotation process. The ore can range in size on up to about 28 mesh (Tyler Standard Sieves Series) though typically a significant fraction of the ore will pass a 100 mesh screen. Adjustment of pH as well as addition of reagents often is conducted during the grinding stage, e.g., to ensure proper mixing and adequate dispersion of reagents, optimum use of reagents, and the like.

The conditioned ore then is admitted to a conventional flotation cell at a concentration of about 15–35 percent solids. Tap water may be used as conventional hard water ion contaminants usually do not adversely effect the sulfide ore froth flotation process. Sulfide froth flotation conditions for present purposes comprehend and are dependent upon the water temperature, air flow, ore solids concentration in the flotation cell, composition and concentration of additives (for example, frother, collector, etc.), and similar factors. Flotation separation times are as short as 5–15 minutes or less depending upon the concentration of ore in the cell, the particular design of the cell utilized, and a variety of other factors well known to the artisans skilled in this field. Note that flotation separation times can be shorter than those typically encountered in present-day commercial flotation operations due to the increased kinetics which the modified alcohol frothers of the present invention display in the process.

The following examples show the present invention can be practiced, but should not be construed as limiting. In this application, all percentages and proportions are by weight, all temperatures are in degrees centigrade, all units are in the metric system, and all mesh sizes are in Tyler Standard Sieves Series, unless otherwise expressly indicated. Also, all references cited herein are expressly incorporated herein by reference.

EXAMPLES

EXAMPLE 1

Copper/molybdenum ore (500 g) in water (300 g) was ground in a rod mill from −10 mesh (Tyler Sieves Series) to 20 wt-% at +100 mesh. The ore assayed at 0.25% Mo and 0.59% Cu. The one slurry in the mill also contained 0.17 g of lime (pH adjustment to 8.7), 0.005 g/kg of NaCN, and 0.015 g/kg of Minerec 1331 thiol collector. The ore was floated in the rougher circuit for 4 minutes following one minute conditioning without air. The scavenger circuit conditions included the use of 0.04 g/kg of #2 fuel oil, one minute conditioning, and a 3 minute float.

Reagents evaluated included conventional methyl isobutyl carbinol (MIBC hereinafter), 2,2,4-trimethyl-1,3-pentane diol iso-butyrate (TMPD mono-isobutyrate hereinafter), and crude TMPD mono-iso-butyrate (undistilled grade of this ester-alcohol which contains esters, alcohols, etc. residual from its manufacture). The following results were recorded.

TABLE 1

| Test | Reagent | | Product (wt %) | | Conc. Assays Mo (wt %) | | Cu (wt %) | % Recovery | |
|---|---|---|---|---|---|---|---|---|---|
| No. | Type | Dosage (g/kg) | Rougher | Scavenger | Rougher | Scavenger | Tailings | Mo | Cu |
| 62-2 | MIBC | 0.15 | 5.14 | 1.59 | 0.378 | 0.055 | 0.15 | 81.9 | 76.2 |
| 62-3 | TMPD mono-iso-Butyrate | 0.15 | 6.81 | 2.22 | 0.266 | 0.085 | 0.11 | 79.2 | 83.0 |
| 62-4 | TMPD mono-iso-Butyrate (crude) | 0.15 | 6.27 | 3.31 | 0.285 | 0.083 | 0.11 | 82.6 | 83.0 |

These results demonstrate the effectiveness of the inventive reagents in selectively floating copper/-molybdenum ores.

EXAMPLE 2

Molybdenum ore (900 g, head assay 0.113 wt-% Mo) was ground to 40% +100 mesh at 60% solids and containing 0.1 g/kg #2 fuel oil and 0.125 g/kg sodium silicate. The resultant slurry was floated in a laboratory 2.5 liter cell (Denver flotation unit, 1100 rpm, open blade) with conventional MIBC and inventive TMPD iso-butyrate reagents at varying dosages. The following results were recorded.

TABLE 2

| Test | Reagent | | Concentrate | | |
|---|---|---|---|---|---|
| No. | Type | Dosage (g/kg) | wt % Floated | % Mo | Mo Recovery (wt %) |
| 71-24 | MIBC | 0.068 | 4.50 | 2.15 | 85.6 |
| 71-26 | MIBC | 0.0315 | 4.76 | 2.02 | 85.0 |
| 71-28 | MIBC | 0.0155 | 3.61 | 2.48 | 79.2 |
| 71-25 | TMPD mono-iso-Butyrate | 0.067 | 6.06 | 1.62 | 86.9 |
| 71-27 | TMPD mono-iso-Butyrate | 0.031 | 5.47 | 1.78 | 86.2 |
| 71-29 | TMPD mono-iso-Butyrate | 0.0155 | 4.91 | 2.04 | 88.7 |

These results demonstrate not only the effectiveness of the inventive reagents, but also their effectiveness at very low dosages. Note especially the results of Tests Nos. 71-28 and 71-29 in this regard.

EXAMPLE 3

Molybdenum ore (900 g, head assay 0.113 wt-% Mo) was ground to 22.5% +100 mesh at 60% solids, and containing 0.125 g/kg sodium silicate. The flotation cell used is described in Example 2. The reagents used and results recorded are set forth in the following table.

TABLE 3

| Test | Reagent* | | Concentrate | | |
|---|---|---|---|---|---|
| No. | Type | Dosage (g/kg) | wt % Floated | % Mo | Mo Recovery (wt %) |
| 71-36 | MIBC<br>#2 F.O. | 0.072<br>0.210 | 4.693 | 2.15 | 89.4 |
| 71-34 | MIBC<br>#2 F.O. | 0.036<br>0.107 | 3.025 | 3.24 | 86.7 |
| 71-32 | MIBC<br>#F.O. | 0.018<br>0.0535 | 2.303 | 3.94 | 80.3 |
| 71-37 | TMPD mono-iso-Butyrate (Crude)<br>#2 F.O. | 0.072<br>0.210 | 6.457 | 1.57 | 89.7 |
| 71-35 | TMPD mono-iso-Butyrate (Crude)<br>#2 F.O. | 0.036<br>0.107 | 4.697 | 2.20 | 91.4 |
| 71-33 | TMPD mono-iso-Butyrate (Crude)<br>#2 F.O. | 0.018<br>0.535 | 3.653 | 2.67 | 86.3 |

*#2 F.O. is #2 Fuel Oil

Again, the excellent performance of the inventive reagents is demonstrated. More importantly, much lower dosages of the reagents of the present invention and a fuel oil are required than when conventional MIBC is used.

EXAMPLE 4

Molybdenum ore (900 g, head assay 0.067% Mo) was ground to 44.5% +100 mesh at 60% solids. The grind was conditioned for one minute and floated for 8 minutes in the laboratory cell of Example 2. The conventional reagent was an equal weight blend of pine oil and MIBC. The following results were recorded.

TABLE 4

| Test No. | Reagent Type | Reagent Dosage (g/kg) | Concentrate wt % Floated | Concentrate % Mo | Mo Recovery (wt %) |
|---|---|---|---|---|---|
| 75-15 | Pine Oil/MIBC<br>#2 F.O. | 0.06<br>0.09 | 4.65 | 1.03 | 71.5 |
| 75-13 | Pine Oil/MIBC<br>#2 F.O. | 0.04<br>0.06 | 3.72 | 1.26 | 70.0 |
| 75-11 | Pine Oil/MIBC<br>#2 F.O. | 0.02<br>0.03 | 2.20 | 1.89 | 62.1 |
| 75-16 | TMPD mono-iso-Butyrate<br>#2 F.O. | 0.06<br>0.09 | 6.28 | 0.78 | 73.1 |
| 75-14 | TMPD mono-iso-Butyrate<br>#2 F.O. | 0.04<br>0.06 | 5.22 | 0.91 | 70.9 |
| 75-12 | TMPD mono-iso-Butyrate<br>#2 F.O. | 0.02<br>0.03 | 3.23 | 1.33 | 64.0 |

Again, the inventive reagent is more effective at all dosages compared to conventional pine oil/MIBC blends. Note the very high solids of ore floated in these tests.

EXAMPLE 5

Molybdenum ore (head assay 0.088% Mo) was ground (41.3% +100 mesh) and floated for 8 minutes using #2 Diesel oil (0.1 g/kg) and sodium silicate (0.125 g/kg). The following results were recorded.

TABLE 5

| Test No. | Reagent Type | Reagent Dosage (g/kg) | Concentrate wt % Floated | Concentrate % Mo | Mo Recovery (wt %) |
|---|---|---|---|---|---|
| 72-1 | MIBC | 0.03 | 2.50 | 2.52 | 71.6 |
| 72-3 | TMPD | 0.03 | 1.96 | 3.30 | 73.5 |
| 72-4 | TMPD mono-Acetate | 0.03 | 3.51 | 1.96 | 78.2 |
| 72-2 | TMPD mono-iso-Butyrate | 0.03 | 3.61 | 1.84 | 75.5 |
| 72-5 | TMPD mono-Heptanate | 0.03 | 4.20 | 1.45 | 69.2 |
| 72-6 | 4 P.O. +<br>Acetic Acid* | 0.03 | 2.90 | 2.29 | 75.5 |

*4 moles of propylene oxide (P.O.) reacted with acetic acid

All of the inventive reagents produced good froths except in Test No. 72-5 which appears to set a practical upper limit of about 7 carbon atoms on a carboxylic acid/$C_5$–$C_{10}$ diol reagent. Again, the reagents of the present invention are demonstrated to be effective in sulfide ore flotation.

EXAMPLE 6

Kinetics and selectivity studies were undertaken on molybdenum ore (head assay 0.088% Mo) using conventional MIBC and TMPD mono-iso-butyrate of the present invention. The ore grind was as follows: 35% +100 mesh, pH 8.0–8.5, #2 Diesel oil dosage of 0.10 g/kg, and sodium silicate dosage of 0.125 g/kg. Both reagents were used at a dosage of 0.03 g/kg of ore floated. The following results were recorded.

TABLE 6

| Test No. | Flotation Time (min) | Wt % Floated in Time Interval | Concentrate Assay % Mo | Concentrate Assay Cumulative % Mo | Mo Recovery (% Cumulative) |
|---|---|---|---|---|---|
| 72-11 | 0–1 | 0.943 | 5.15 | 5.15 | 55.2 |
| MIBC | 1–2 | 0.633 | 1.18 | 3.56 | 63.7 |
| | 2–4 | 0.351 | 0.605 | 3.13 | 66.1 |
| | 4–8 | 1.015 | 0.21 | 2.05 | 68.5 |
| | Tails | 97.06 | — | — | — |
| 72-12 | 0–1 | 2.52 | 2.40 | 2.52 | 68.7 |
| TMPD | 1–2 | 0.71 | 0.46 | 2.11 | 72.4 |
| mono-iso- | 2–4 | 0.96 | 0.12 | 1.65 | 73.8 |
| Butyrate | 4–8 | 0.86 | 0.05 | 1.38 | 74.3 |
| | Tails | 94.95 | — | — | — |

These results demonstrate the improved flotation kinetics which the reagents of the present invention achieve. Just as important, however, is that selectivity for molybdenum flotation is improved also. Note that at approximately the same molybdenum recoveries of 68.5% and 68.7%, the cumulative concentrate assay for MIBC was 2.05% molybdenum and 2.52% molybdenum for TMPD mono-iso-butyrate.

EXAMPLE 7

Further kinetics/selectivity studies were undertaken on molybdenum ore (head assay 0.108% Mo) as in Example 6. The grind formed is as follows: 40% +100 mesh, pH 8.0–8.5, #2 fuel oil dosage of 0.1 g/kg, and sodium silicate dosage of 0.125 g/kg. The following results were recorded.

TABLE 7

| Test No. | Flotation Time (min) | Wt % Floated in Time Interval | Concentrate Assay % Mo | Concentrate Assay Cumulative % Mo | Mo Recovery (% Cumulative) |
|---|---|---|---|---|---|
| 71-15 | 0–1 | 1.51 | 5.36 | 5.36 | 74.8 |
| MIBC | 1–2 | 0.86 | 0.805 | 3.70 | 81.2 |
| | 2–4 | 0.72 | 0.390 | 3.28 | 83.8 |
| | 4–8 | 1.04 | 0.155 | 2.43 | 85.3 |
| | Tails | 95.88 | — | — | — |
| 71-16 | 0–1 | 3.25 | 2.750 | 2.75 | 82.7 |
| TMPD | 1–2 | 1.00 | 0.425 | 2.20 | 86.6 |
| mono-iso- | 2–4 | 0.61 | 0.165 | 1.95 | 87.6 |
| Butyrate | 4–8 | 0.83 | 0.070 | 1.67 | 88.1 |
| | Tails | 94.31 | — | — | — |

Again, the improved kinetics of the reagents of the present invention compared to conventional MIBC is demonstrated.

EXAMPLE 8

In this series of tests, grind time was correlated to molybdenum (head assay 0.108% Mo) recovery for the reagents studied in Examples 6 and 7. The following grind was formed: 60% solids, #2 fuel oil dosage of 0.125 g/kg, and sodium silicate dosage of 0.125 g/kg. The dosage of MIBC and TMPD mono-iso-Butyrate reagents was 0.03 g/kg. The following results were recorded.

TABLE 8

| Test No. | Reagent | Grind Time (min) | Concentrate wt % Floated | Concentrate % Mo | Mo Recovery (wt %) |
|---|---|---|---|---|---|
| 71-17 | MIBC | 5 | 4.86 | 1.77 | 79.55 |
| 71-15 | MIBC | 10 | 4.12 | 2.43 | 85.3 |
| 71-13 | MIBC | 15 | 2.95 | 1.90 | 83.2 |
| 71-19 | MIBC | 20 | 3.21 | 2.86 | 84.9 |
| 71-18 | TMPD mono-iso-Butyrate | 5 | 4.98 | 1.81 | 83.25 |
| 71-16 | TMPD mono-iso-Butyrate | 10 | 5.69 | 1.67 | 88.1 |
| 71-14 | TMPD mono-iso-Butyrate | 15 | 4.95 | 1.95 | 89.25 |
| 71-20 | TMPD mono-iso-Butyrate | 20 | 5.31 | 1.63 | 88.5 |

These results once again establish the superiority of the reagents of the present invention. Increased grind times, up to a point, appear to result in improved molybdenum recoveries for the present reagent. The same does not appear to be true for conventional MIBC.

EXAMPLE 9

A 900 g sample of molybdenum ore (head assay 0.088% Mo) was placed in a rod mill and ground with 600 g $H_2O$ for 15 minutes to obtain a grind of 40% +100 mesh. Flotation was conducted with 0.1 g/kg of #2 Diesel oil and 0.03 g/kg of various reagents with the following results being recorded.

TABLE 9

| Test No. | Reagent* Type | Concentrate wt % Floated | Tails wt % Mo. | Mo Recovery (wt %) |
|---|---|---|---|---|
| 72-20 | MIBC | 2.862 | 0.120 | 86.4 |
| 72-19 | TMPD + Acrylonitrile | 3.514 | 0.0110 | 88.0 |
| 72-21 | TMPD + Acetic Acid | 3.140 | 0.0085 | 90.7 |

*Reaction product of a 1:1 molar ratio of TMPD and acrylonitrile or acetic acid.

Yet again are the reagents of the present invention demonstrated to be effective in sulfide ore flotation.

EXAMPLE 10

A low-grade copper/molybdenum ore (0.045 wt-% Cu and 0.095 wt-% Mo) was ground to 45 %+100 mesh and floated for 6 minutes using #2 fuel oil (0.03 g/kg) and various frothers (0.02 g/kg). The frothers evaluated are set forth below.

| Test No. | Frothers |
|---|---|
| 146-16 | Dowfroth 250-Alkyl monoether of propylene glycol, U.S. Pat. No. 2,611,485, Dow Chemical Company |
| 146-5 | Reaction product of TMPD and acrylonitrile (one mole) |
| 146-4 | Reaction product of TMPD and 3 moles of propylene oxide (P.O.) |
| 146-11 | Reaction product of TMPD and 3 moles of ethylene oxide (E.O.) |
| 146-12 | Reaction product of 2-ethylhexyl-1,3-diol (2 EH-Diol) and acetic acid (one mole) |
| 146-15 | Reaction product of 2-ethylhexyl-1,3-diol (2 EH-Diol) and acrylonitrile (one mole) |
| 146-7 | Reaction product of 1,6-hexane diol (1,6 HD) and propylene oxide (3 moles) |
| 146-8 | Reaction product of neo-pentyl glycol (NPG) and acrylonitrile (one mole) |
| 146-6 | Reaction product of neo-pentyl glycol (NPG) and propylene oxide (3 moles) |
| 146-9 | Reaction product of 1,3-butane diol (1,3-BD) and acetic acid (one mole) |
| 146-10 | Reaction product of trimethylolpropane (TMP) and acetic acid (one mole) |

The following results were recorded.

TABLE 10

| Test No. | Reagent | Concentrate wt % Floated | % Mo in Concentrate | % Mo in Tails | % Mo Recovery | % Cu in Tails | % Cu Recovery |
|---|---|---|---|---|---|---|---|
| Comparative | | | | | | | |
| 146-2 | MIBC | 3.00 | 2.71 | 0.01425 | 85.5 | 0.008 | 82.8 |
| 146-16 | Dowfroth 250 | 1.98 | 4.18 | 0.01250 | 87.2 | 0.008 | 82.8 |
| 146-13 | Diethyl Adipate | 4.13 | 2.07 | 0.01000 | 89.9 | 0.007 | 85.1 |
| Inventive | | | | | | | |
| 146-19 | TMPD mono- | 2.73 | 2.95 | 0.0150 | 84.6 | 0.009 | 80.5 |
| 146-3 | TMPD iso-Butyrate | 2.68 | 3.13 | 0.0115 | 88.2 | 0.008 | 82.7 |
| 146-5 | TMPD + Acrylonitrile | 2.39 | 3.46 | 0.0125 | 87.2 | 0.002 | 95.6 |
| 146-4 | TMPD + 3 P.O. | 3.19 | 2.63 | 0.0115 | 88.3 | 0.007 | 84.9 |
| 146-11 | TMPD + 3 E.O. | 3.40 | 2.50 | 0.0105 | 89.3 | 0.008 | 82.8 |
| 146-18 | 2-Ethylhexyl-1,3-Diol | 2.10 | 3.82 | 0.0150 | 84.5 | 0.009 | 80.4 |
| 146-12 | 2EH-Diol + Acetic Acid | 3.75 | 2.26 | 0.0105 | 89.4 | 0.007 | 85.0 |
| 146-15 | 2EH-Diol + Acrylonitrile | 2.81 | 2.20 | 0.0115 | 88.2 | 0.008 | 82.7 |
| 146-20 | 1,6-Hexane Diol | 3.44 | 1.88 | 0.0315 | 68.0 | 0.015 | 67.8 |
| 146-7 | 1,6-HD + 3 P.O. | 2.92 | 2.97 | 0.0086 | 91.2 | 0.008 | 82.7 |
| 146-17 | Neo-Pentyl Glycol | 2.17 | 2.51 | 0.0415 | 57.3 | 0.019 | 58.7 |
| 146-8 | NPG + Acrylonitrile | 2.91 | 2.70 | 0.0170 | 82.6 | 0.009 | 80.6 |
| 146-6 | NPG + 3 P.O. | 3.14 | 2.80 | 0.0074 | 92.5 | 0.002 | 95.7 |
| 146.9 | 1,3-BD + Acetic Acid | 3.60 | 1.85 | 0.0295 | 70.1 | 0.015 | 67.9 |
| 146-10 | TMP + Acetic Acid | 3.22 | 2.12 | 0.0275 | 72.0 | 0.013 | 72.0 |

Numerous additional reagents are shown effective in sulfide ore floats in the above-tabulated results. Note that the modified reagents are more effective than the diols alone.

We claim:

1. In a froth flotation process for concentration of a metal sulfide ore in the froth by subjecting an aqueous slurry of metal sulfide ore particles to sulfide ore froth flotation under sulfide ore froth flotation conditions comprising a metal sulfide ore collector, the improvement which comprises using an effective amount of a frothing agent selected from the group consisting of:

(a) the reactant product of a $C_5$–$C_{10}$ diol and a $C_1C_7$ carboxylic acid in a ratio of one mole of carboxylic acid per mole of diol and having the predominant structural formula of $$HO-(C_nH_{2n})-O-\overset{\overset{\displaystyle O}{\|}}{C}-(C_xH_{2x})-H$$

where n=5–10 and x=0–6;

(b) the reaction product of a $C_5$–$C_{10}$ diol and an acrylonitrile in a mole ratio of one mole of acrylonitrile to one mole of diol such that the reaction product retains at least one hydroxyl group and having the predominant structural formula of $$HO-(C_nH_{2n})-O-CH_2\overset{\overset{\displaystyle (C_mH_{2m+1})}{|}}{C}H-C{\equiv}N$$

where n=5–10 and m=0–3;

(c) the reaction product of between about 1 and 10 moles of a $C_2$–$C_3$ alkylene oxide per mole of a $C_1$–$C_7$ carboxylic acid and having the predominant structural formula of $$H-(C_xH_{2x})-\overset{\overset{\displaystyle O}{\|}}{C}-O-(C_yH_{2y}O)_z-H$$

where x=0–6, y=2–3, and z=1–10;

(d) the reaction product of between about 1 and 10 moles of a $C_2$–$C_3$ alkylene oxide and one mole of $C_5$–$C_{10}$ diol and having the predominant structural formula of $$HO-(C_nH_{2n})-O-(C_yH_{2y}O)_z-H$$

where n=5–10, y=2–3, and z=1–10; and (e) mixtures thereof.

2. The process of claim 1 wherein the effective amount of said frothing agent ranges from between about 0.001 to about 0.50 g/kg of ore.

3. The process of claim 1 wherein said frothing agent is reaction product (a).

4. The process of claim 1 wherein said frothing agent is the reaction product (c).

5. The process of claim 1 wherein said frothing agent is the reaction product (b).

6. The process of claim 5 wherein said frothing agent is the reaction product of 2,2,4-trimethyl-1,3-pentane diol and an acrylonitrile.

7. The process of claim 1 wherein said frothing agent is the reaction product (d).

8. The process of claim 7 wherein said frothing agent is the reaction product of neo-pentyl glycol and propylene oxide.

9. The process of claim 7 wherein said frothing agent is reaction product of 1,6-hexane diol and propylene oxide.

10. The process of claim 1 wherein the diol for frothing agent (a), (b), and (c) is selected from the group of 2,2,4-trimethyl-1,3-pentane diol, 2-ethyl-1,3-hexane diol, 1,6-hexane diol, neo-pentyl glycol, and mixtures thereof.

11. The process of claim 10 wherein said diol comprises 2,2,4-trimethyl-1,3-pentane diol.

12. The process of claim 1 wherein the alkylene oxide of frothing agent (c) and (d) comprises propylene oxide.

13. The process of claim 12 wherein the number of moles of propylene oxide in the reaction product of said frothing agent ranges from between about 2 and about 10.

* * * * *